US009945096B2

(12) United States Patent
Cherney

(10) Patent No.: US 9,945,096 B2
(45) Date of Patent: Apr. 17, 2018

(54) FORCE-BASED WORK VEHICLE BLADE PITCH CONTROL

(71) Applicant: Deere & Company, Moline, IL (US)

(72) Inventor: Mark J. Cherney, Potosi, WI (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 15/040,868

(22) Filed: Feb. 10, 2016

(65) Prior Publication Data

US 2017/0226717 A1 Aug. 10, 2017

(51) Int. Cl.

| | |
|---|---|
| ***E02F 3/84*** | (2006.01) |
| ***E02F 3/76*** | (2006.01) |
| ***E02F 9/22*** | (2006.01) |
| ***E02F 9/20*** | (2006.01) |

(52) U.S. Cl.

CPC ..... *E02F 3/844* (2013.01); *E02F 3/7618* (2013.01); *E02F 9/2029* (2013.01); *E02F 9/2041* (2013.01)

(58) Field of Classification Search

CPC ..... E02F 3/844; E02F 3/7618; E02F 9/2029; E02F 9/2041; E02F 9/2253

USPC ..... 701/50

See application file for complete search history.

(56) References Cited

U.S. PATENT DOCUMENTS

| | | | | |
|---|---|---|---|---|
| 6,181,999 | B1 * | 1/2001 | Yamamoto | E02F 3/844 172/4.5 |
| 6,845,311 | B1 | 1/2005 | Stratton et al. | |
| 7,917,265 | B2 | 3/2011 | Kale et al. | |
| 8,141,650 | B2 | 3/2012 | Breiner et al. | |
| 8,548,690 | B2 | 10/2013 | Hayashi | |
| 8,626,404 | B2 * | 1/2014 | Thomson | E02F 3/84 180/197 |
| 8,726,543 | B2 | 5/2014 | Kelly | |
| 2008/0127530 | A1 * | 6/2008 | Kelly | E02F 9/2029 37/403 |
| 2013/0087351 | A1 | 4/2013 | Sulzer | |
| 2015/0330057 | A1 | 11/2015 | Faivre et al. | |

FOREIGN PATENT DOCUMENTS

| | | | |
|---|---|---|---|
| EP | 1586711 | A2 | 10/2005 |

* cited by examiner

*Primary Examiner* — Brian P Sweeney
(74) *Attorney, Agent, or Firm* — Lorenz & Kopf, LLP

(57) ABSTRACT

A system and method for automatically adjusting blade pitch in crawler dozers, motor graders, and other bladed work vehicles includes estimating a current tractive force of the work vehicle utilizing one or more controllers that establish whether the current tractive force of the work vehicle can be reduced by rotating the blade to an optimized pitch angle. A command is transmitted from the one or more controllers to a blade actuation system to rotate the blade to the optimized pitch angle. The method may be performed iteratively to repeatedly adjust the blade pitch to optimized angles as the work vehicle operates and conditions affecting the optimal blade pitch angle vary.

15 Claims, 5 Drawing Sheets

FORCE-BASED WORK VEHICLE BLADE PITCH CONTROL

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates generally to work vehicles and, more particularly, to a system and method for automatically adjusting blade pitch in crawler dozers, motor graders, and other bladed work vehicles.

BACKGROUND OF THE DISCLOSURE

Crawler dozers (hereafter "dozers"), motor graders (hereafter "graders"), and other bladed work vehicles are well-suited for spreading, shearing, carrying, and otherwise moving relatively large volumes of earth. For this reason, dozers and graders are often utilized in tandem when removing or redistributing earth to impart a tract of land (hereafter an "open ground worksite") with a final grade or surface contour. Grading of an open ground worksite is commonly performed in two or more phases. During an initial rough cutting phase, dozers and possibly other work vehicles, such as tractor-scrapers, are utilized for bulk earth moving purposes. A fine grading phase may then be performed after the rough cutting phase is completed. During fine grading, graders may be utilized to create a finished grade across the upper surface of the open ground worksite, for example, corresponding to a previously-prepared topological map.

Bladed work vehicles are now commonly equipped with blade actuation systems enabling an operator to manipulate a work vehicle's blade in multiple degrees of freedom (DOFs). In the case of a crawler dozer, for example, an operator may be able to adjust the height, pitch, and rotational angle of the blade through an electro-hydraulic blade actuation system, which is integrated into a blade control assembly mounting the blade to a forward portion of the dozer. Similarly, in the case of a grader, an operator may be able to adjust blade height, blade pitch, and blade rotational angle, as well as the lateral position of the blade relative to the grader chassis within certain limits. Such multi-DOF blade movement provides a powerful and flexible tool in earthmoving operations. However, as the freedom of blade movement increases, so too does the complexity of the operator controls utilized to control blade movement. This, in turn, provides greater opportunities for sub-optimal positioning of the blade and increases the mental workload placed on an operator of the bladed work vehicle.

Advanced Grade Control Systems (GCSs) have been developed for automatically controlling the blade height and cut depth of graders and other bladed work vehicles. In contrast, such systems may not provide automatic control and optimization of blade pitch. The manner in which blade pitch is controlled during a grading operation can directly affect productivity, fuel consumption, and other measures of work vehicle efficiency. A skilled operator can improve work vehicle efficiency by maintaining the blade pitch at an optimal angle when operating a bladed work vehicle. However, the optimal blade pitch angle may vary with multiple dynamic factors including cut depth, material type, material density, moisture content, and so on. Consequently, it can be difficult for even a skilled operator to consistently maintain blade pitch within an optimal range throughout a grading operation or other task, while simultaneously controlling the various other operational parameters of the work vehicle.

SUMMARY OF THE DISCLOSURE

A system and method for automatically adjusting blade pitch in crawler dozers, motor graders, and other bladed work vehicles are provided.

In one embodiment, the method includes the step or process of estimating a current tractive force of the work vehicle utilizing one or more controllers onboard the work vehicle. The one or more controllers further establish whether the current tractive force of the work vehicle can be reduced by rotating the blade to an optimized pitch angle. When establishing that the current tractive force of the work vehicle can be reduced by rotating the blade to an optimized pitch angle, a command is transmitted from the one or more controllers to a blade actuation system, which then rotates the blade to the optimized pitch angle. The method may be performed iteratively to repeatedly or continually adjust the blade pitch to optimized angles as the work vehicle operates and conditions affecting the optimal blade pitch angle vary. The productivity, fuel consumption, and/or other measures of work vehicle efficiency may be improved as a result.

In further embodiments, the method for automatically adjusting blade pitch in a bladed work vehicle may include other steps or processes in addition to or lieu of those set-forth above. For example, in another embodiment of the method, it may be determined whether the work vehicle is currently operating in a loading phase rather than another operative phase, such as a carry phase. When it is determined that the work vehicle is currently operating in a loading phase, one or more controllers onboard the work vehicle may then execute a loading phase algorithm. The loading phase algorithm may include the steps or processes of: (i) estimating a tractive force component required to overcome soil cut and roll resistance forces ($TF_{CUT_ACTUAL}$) during loading; (ii) determining a blade pitch adjustment at least partially based on $TF_{CUT_ACTUAL}$; and (iii) transmitting a command to the blade actuation system to implement the blade pitch adjustment.

Embodiments of dozers, graders, and other bladed work vehicles are further provided. In one embodiment, the bladed work vehicle includes a blade having a pitch angle, a blade actuation system coupled to the blade and configured to adjust the pitch angle thereof, one or more sensors configured to provide data indicative of a current tractive force of the work vehicle, and one or more controllers coupled to the blade actuation system and to the one or more sensors. The one or more controllers include instructions for the execution of an auto pitch control function during which: (i) sensor data is received from the one or more sensors indicative of a current tractive force of the work vehicle; (ii) it is determined whether the current tractive force of the work vehicle can be reduced by rotating the blade to an optimized pitch angle by the sensor data; and (iii) when the current tractive force of the work vehicle can be reduced by rotating the blade to an optimized pitch angle, a command is automatically transmitted from the one or more controllers to the blade actuation system to rotate the blade to the optimized pitch angle.

The details of one or more embodiments are set-forth in the accompanying drawings and the description below. Other features and advantages will become apparent from the description, the drawings, and the claims.

BRIEF DESCRIPTION OF THE DRAWINGS

At least one example of the present invention will hereinafter be described in conjunction with the following figures, wherein like numerals denote like elements, and.

DETAILED DESCRIPTION

Figure 1:
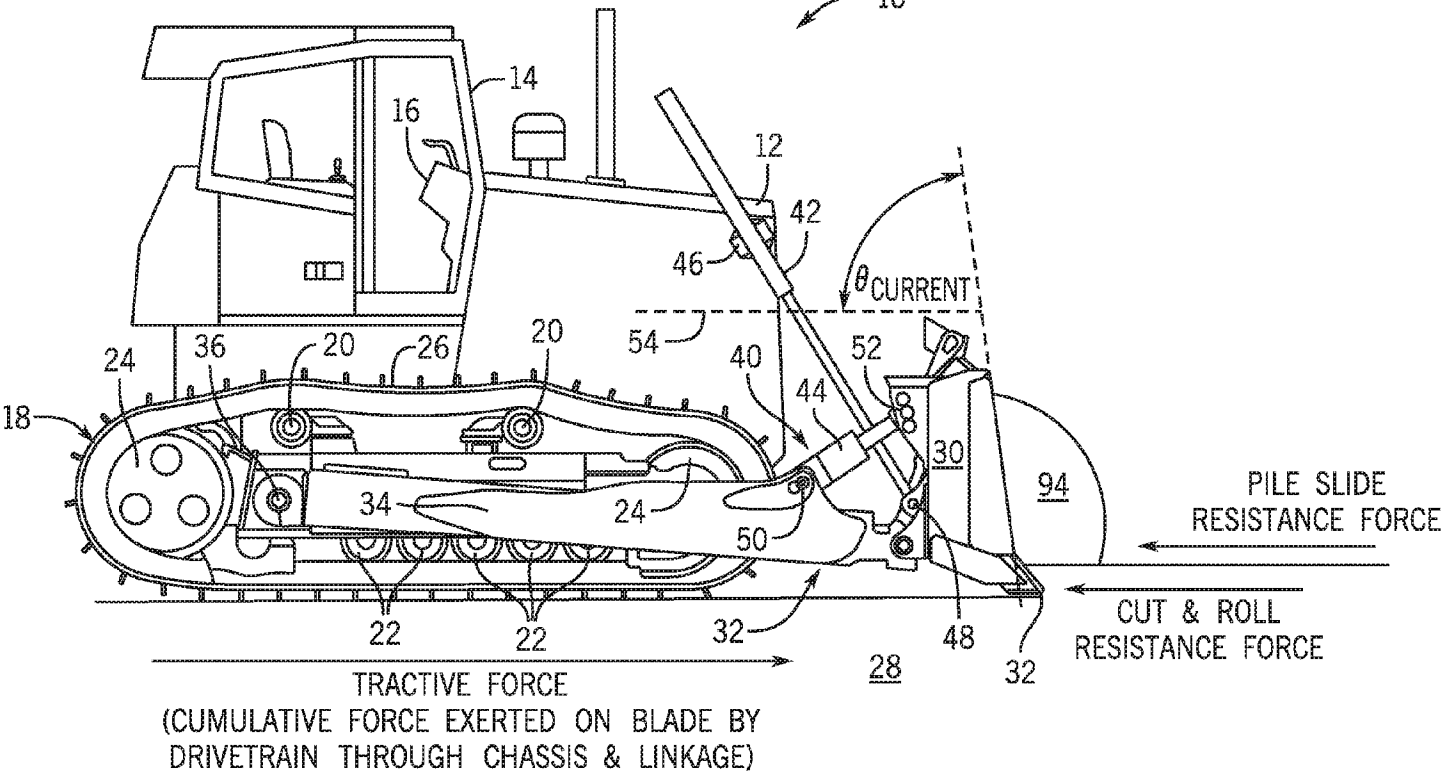
FIG. 1 is a side view of a crawler dozer including a blade control linkage, as illustrated in accordance with an example embodiment of the present disclosure.

The following describes one or more example embodiments of the disclosed blade pitch control system and method, as shown in the accompanying figures of the drawings described briefly above. Various modifications to the example embodiment(s) may be contemplated by one of skill in the art.

It may be desirable to provide systems and methods for automatically adjusting blade pitch in a dozer, grader, or other bladed work vehicle in a manner that optimizes the blade pitch angle and boosts overall work vehicle efficiency. Ideally, embodiments of such systems and methods would enable blade pitch optimization through one or more phases of a grading operation, such as a loading and/or carrying phase, when the blade pitch angle has a more pronounced effect on work vehicle efficiency.

The following describes a system and method for automatically adjusting blade pitch in crawler dozers, motor graders, and other bladed work vehicles. Embodiments of the bladed work vehicle may be equipped with a blade, a blade actuation system, and one or more controllers associated with computer-readable instructions for the selective execution of one or more algorithms or processes referred to herein as an "auto pitch control function." When executed, the auto pitch control function determines whether a minimum reduction in a current tractive force of the work vehicle can be achieved by rotating the work vehicle's blade to a new, optimized blade pitch angle ($\theta_{OPTIMAL}$). If it is determined that a minimum reduction in the tractive force of the work vehicle can be so achieved, the controller transmits a command to the blade actuation system to implement a corresponding pitch angle adjustment. The auto pitch control function may be performed iteratively such that the blade pitch is repeatedly or continually adjusted during operational of the work vehicle in response to changes in operational phase, cut depth, blade volume, and/or other dynamic factors affecting the optimized pitch angle. By continually optimizing the blade pitch angle in this manner, embodiments of the systems and methods can improve the overall efficiency of the work vehicle, whether considered from the standpoint of productivity (e.g., material volume moved over a given duration of time), from the standpoint of fuel consumption (e.g., fuel consumed for amount of work performed), or from the standpoint of another efficiency metric. As a further benefit, the automatic adjustment of the blade pitch angle helps simplify the manual control requirements of the work vehicle to ease the mental burden placed on the work vehicle operator in a high workload environment.

Embodiments of the system and method described herein may identify whether a minimum reduction in the tractive force of a bladed work vehicle can be realized by rotating the blade to an optimized pitch angle in a number of different manners. In certain embodiments, this is accomplished by rotating the blade through a number of test angles, while receiving data indicative of a tractive force of the bladed work vehicle at each of the plurality of test pitch angles. The optimized pitch angle may then be determined at least partially based on one or more of the plurality of test pitch angles at which the tractive force of the work vehicle is the least. In other embodiments, the determination of whether a minimum reduction in tractive force can be achieved by rotating the blade to a new optimal blade pitch angle may be predicted or forecast utilizing sensor data and virtual modeling techniques. In this case, an expected tractive force may be determined utilizing one or more adaptive models and then compared to the actual or measured tractive force of the bladed work vehicle. If a sufficient disparity exists between the expected tractive force and the actual tractive force, it may be concluded that a minimum reduction in tractive force is likely achievable by rotating the blade to a new, optimized blade pitch angle ($\theta_{OPTIMAL}$). The optimized pitch angle ($\theta_{OPTIMAL}$) may also be derived from the adaptive virtual model based, at least in part, on the disparity between the expected tractive force and the actual tractive force of the work vehicle. The virtual model may be "adaptive" in the sense that the model may consider past performance of the work vehicle, variable environmental conditions, variable hydrostatic transmission inefficiencies, variable friction coefficients, and/or other adaptive inputs. In certain embodiments, different virtual models may be recalled and utilized for disparate operative phases of the bladed work vehicle. For example, an adaptive carry model may be utilized when the work vehicle is operating in a carry mode, while an adaptive loading model may be utilized when the work vehicle is operating in a loading mode.

As indicated above, embodiments of the auto pitch control function can be performed during the loading and/or carrying phases of a grading task. When performed during the loading phase, a controller executing the auto pitch control function may perform a loading phase sub-process. During the loading phase sub-process, the actual tractive force of the work vehicle may first be calculated based on sensor data or otherwise determined. Afterwards, a component of the actual tractive force required to overcome soil cut and roll forces ($TF_{CUT_ACTUAL}$), specifically, may be estimated. The controller may then establish an expected tractive force component required to overcome the soil cut and roll forces ($TF_{CUT_EXPECTED}$) by, for example, inputting the current cut depth of the blade and/or other adaptive data into an adaptive loading model. The controller can determine an optimal blade pitch angle ($\theta_{OPTIMAL}$) as a function of the differential between $TF_{CUT_EXPECTED}$ and $TF_{CUT_ACTUAL}$ when this differential exceeds a minimum threshold value. Finally, the controller may transmit a command to the blade actuation system to rotate the blade to the newly-determined optimal blade pitch angle ($\theta_{OPTIMAL}$). In so doing, the controller can calculate the optimal blade pitch angle ($\theta_{OPTIMAL}$) in a simplified, yet accurate manner during a loading task, such as during the loading phase of a grading operation.

In still further embodiments, the controller or controllers carrying-out the auto pitch control function may first identify whether the work vehicle is currently operating in either a loading phase or a carry phase. If the work vehicle is instead currently operating in the loading phase, the controller may transmit a command to the blade actuation system to rotate the blade to a first optimized pitch angle. If the work vehicle is currently operating in the carry phase, the controller may transmit a command to the blade actuation system to rotate the blade to a second optimized pitch angle different than (e.g., less than) the first optimized pitch angle.

Embodiments of the system and method for automatically adjusting blade pitch in a bladed work vehicle will now be described with reference to FIGS. 1-5. For purposes of explanation, the following will primarily describe embodiments of the system and method in conjunction with an example crawler dozer shown in FIGS. 1-2. The following notwithstanding, it is emphasized that embodiments of the system and method described herein can be utilized in conjunction with various other types of dozers, graders, and other bladed work vehicles.

FIG. 1 is a side view of a tracked crawler dozer 10, as illustrated in accordance with an example embodiment of the present disclosure. The crawler dozer 10 includes a chassis 12, a cabin 14 supported by the chassis 12, and a number of operator controls 16 located within the cabin 14. The crawler dozer 10 further includes a tracked undercarriage 18 containing top rollers 20, bottom rollers 22, sprockets and/or idlers 24, and twin tracks 26. In further embodiments, the tracked undercarriage 18 can be replaced by a different type of undercarriage including wheels, friction or positively-driven belts, or another ground-engaging mechanism suitable for moving the crawler dozer 10 across a tract of land, such as off-road terrain 28 identified in FIG. 1.

The crawler dozer 10 further includes a blade 30 having a lower cutting edge 32. The blade 30 is mounted to a forward portion of the chassis 12 by an outer blade control linkage 32, which is constructed of various links, joints, and other structural elements. The blade control linkage 32 can include, for example, a push frame 34 joined to tracked undercarriage 18 at pivot points 36. A blade actuation system 40 is further provided, the components of which may be generally interspersed or integrated with the components of the blade control linkage 32. The blade actuation system 40 can include any number and type of actuators suitable for enabling an operator of the crawler dozer 10 to control the position of the blade 30 relative to the chassis 12. In the illustrated example, the blade actuation system 40 includes two hydraulic lift cylinders 42 (only one of which can be seen in FIG. 1) and two hydraulic pitch cylinders 44 (again only of which can be seen). The lift cylinders 42 are each pivotally coupled to chassis 12 at a first pivot point 46 and further pivotally coupled to blade 30 at a second pivot point 48 such that extension and retraction of the lift cylinders 42 raises or lowers the blade 30. Similarly, the pitch cylinders 44 are each pivotally coupled to the push frame 34 at a first pivot point 50 and further pivotally coupled to blade 30 at a second pivot point 52 such that extension and retraction of the pitch cylinders 44 adjusts the pitch of the blade 30. In certain cases, it may also be possible to adjust the tilt angle of the blade 30 by commanding the pitch cylinders 44 to different stroke positions; e.g., by extending one of the pitch cylinders 44, while simultaneously retracting the other pitch cylinder 44.

As indicated above, the blade control linkage 32 and the blade actuation system 40 shown in FIG. 1 are provided purely by way of non-limiting example. In further embodiments of the crawler dozer 10, the blade control linkage 32 and the blade actuation system 40 can vary such that movement of the blade 30 may be controlled in a different manner. For example, in another embodiment, the blade actuation system 40 may include a single pitch cylinder 44, which can be extended or retracted to adjust the blade 30. Additionally, a non-hydraulic, manual mechanism may also be provided for adjusting blade pitch in certain embodiments. In this regard, and as a further non-limiting example, a single pitch cylinder 44 may be coupled to a first side of the blade 30 to allow remote hydraulic control of the pitch angle of the blade 30, as described herein, while the opposing side of the blade 30 may be coupled to a jackscrew that can be utilized to manually adjust blade pitch. Generally, then, it should be understood that the blade control linkage 32 and the blade actuation system 40 can assume any form enabling the pitch of the blade 30 to be remotely controlled utilizing the operator controls 16 and automatically adjusted by one or more systems onboard the crawler dozer 10 (or other bladed work vehicle) in the manner described more fully below.

With continued reference to the example embodiment shown in FIG. 1, the hydraulic pitch cylinders 44 can thus be extended or retracted to pitch the upper edge of the blade 30 forward or afterward, respectively. Stated differently, the stroke position of the hydraulic pitch cylinders 44 can be controlled to adjust the blade pitch angle of the blade 30. As appearing herein, the term "blade pitch angle" is defined as an angle formed between the height dimension of the blade face (or a line tangent to the top and bottom edges of the blade face when curved) and a line parallel to the centerline of the crawler dozer 10. This angle is depicted identified in FIG. 1 by double-headed arrow ($\theta_{CURRENT}$), and the centerline of the crawler dozer 10 (or a line parallel to the dozer centerline) is represented by dashed line 54. When the hydraulic pitch cylinders 44 are fully extended, the blade 30 is pitched forward and may be considered to have a highly aggressive pitch angle. In this position, the blade pitch angle ($\theta_{CURRENT}$) may be equal to or slightly less than 90 degrees (°) in an embodiment. When the hydraulic pitch cylinders 44 are fully retracted, the blade 30 is pitched backward and may be considered to have a minimally aggressive or "laid back" pitch angle. In this position, the blade pitch angle ($\theta_{CURRENT}$) may be equal to approximately 45°, as a further non-limiting example.

Figure 2:
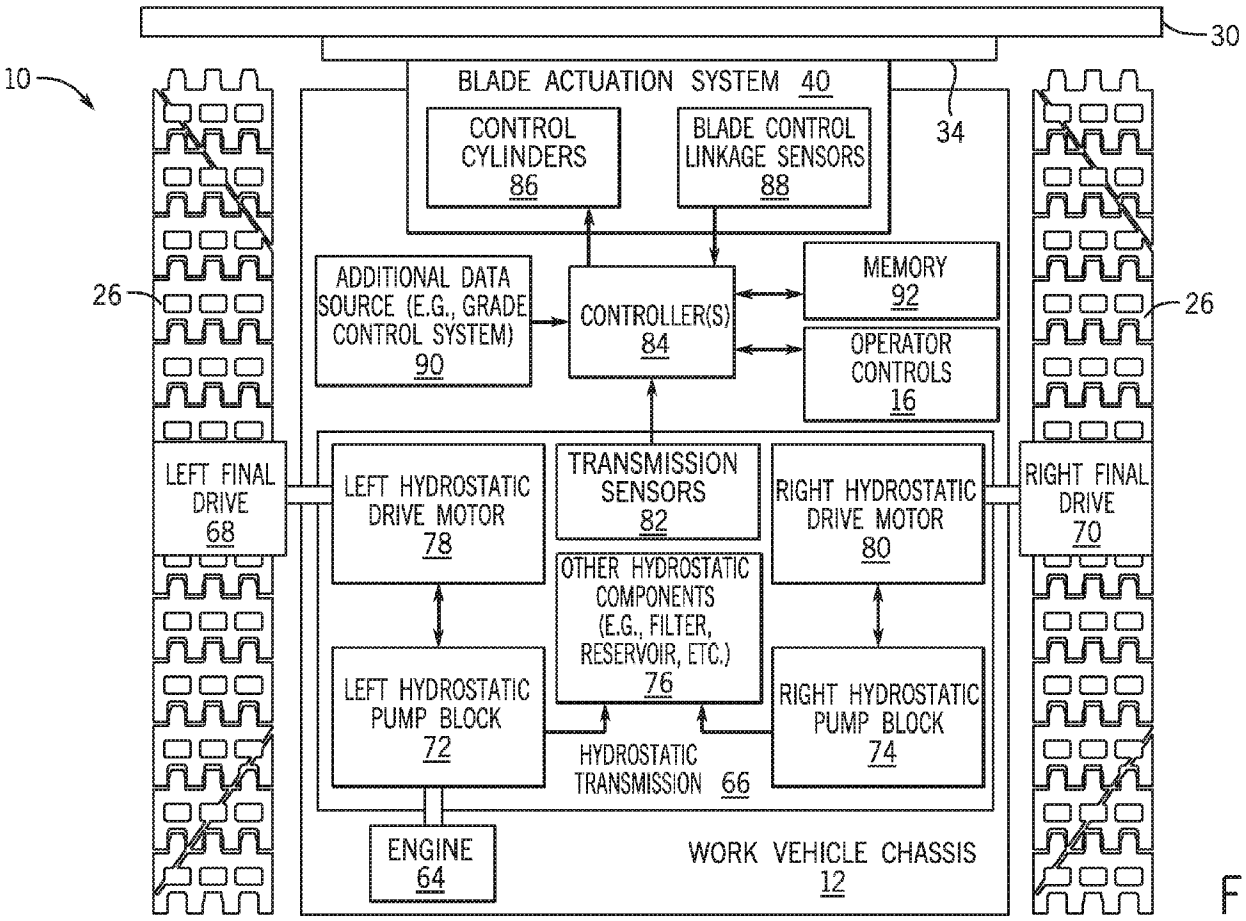
FIG. 2 is a schematic representation of the example crawler dozer shown in FIG. 1.

Advancing now to FIG. 2, a schematic of the example crawler dozer 10 is shown. Here, it can be seen that the crawler dozer 10 includes a number of additional components beyond those previously described in conjunction with FIG. 1. Such additional components can include, for example, an engine 64 (e.g., a diesel engine), a hydrostatic transmission 66, a left final drive 68, and a right final drive 70. During operation of the crawler dozer 10, the engine 64 drives rotation of the tracks 26 through the hydrostatic transmission 66 and the final drives 68,70. More specifically, the rotating mechanical output of the engine 64 drives left and right hydrostatic pumps 72, 74 that may be included within the hydrostatic transmission 66. The hydrostatic pumps 72, 74 are fluidly interconnected through other fluid-conducting components 76 of the hydrostatic transmission 66, such as filters, reservoirs, heat exchangers, and the like. The hydrostatic pumps 72, 74 are further fluidly coupled to and drive hydrostatic motors 78, 80 contained with the hydrostatic transmission 66. The mechanical outputs of the hydrostatic drive motors 78, 80 then drive rotation of sprockets engaging the tracks 26 through the final drives 68, 70. The engine and the powertrain of the crawler dozer 10 (or other bladed work vehicles described herein) can vary in other embodiments.

One or more hydrostatic transmission sensors 82 are further included in the hydrostatic transmission 66. The hydrostatic transmission sensors 82 can include pressure sensors for monitoring the loop pressure differential across the hydrostatic transmission 66, sensors for monitoring the piston displacements of the hydrostatic drive motors 78, 80, and/or sensors for measuring various other operational characteristics of the hydrostatic transmission 66. During operation of the crawler dozer 10, the hydrostatic transmission sensors 82 supply data describing such operational parameters to one or more controllers onboard the crawler dozer 10. The one or more controllers are schematically represented in FIG. 2 by a single block "84" and will be referred to as "controller 84" hereafter for ease of reference. It will be noted, however, that the controller 84 can include any number of processing devices, which can be distributed throughout the crawler dozer 10 and interconnected utilizing different communication protocols and memory architectures. The data received by the controller 84 from the hydrostatic transmission sensors 82 and the other sensors described below is then utilized to carry-out an auto pitch control function, as explained in more detail in conjunction with FIGS. 3-5.

Thus, as schematically illustrated in FIG. 2, the controller 84 can include or assume the form of any electronic device, subsystem, or combination of devices suitable for performing the processing and control functions described herein. In this regard, the controller 84 may be implemented utilizing any suitable number of individual microprocessors, memories, power supplies, storage devices, interface cards, and other standard components known in the art. Additionally, the controller 84 may include or cooperate with any number of software programs or instructions designed to carry-out various methods, process tasks, calculations, and control functions described herein. The controller 84 may further include or function in conjunction with a memory containing any number of volatile and/or non-volatile memory elements. The memory will typically include a central processing unit register, a number of temporary storage areas, and a number of permanent storage areas that store the data and programming required for operation of the controller 84. Such memory elements are collectively identified as a separate block entitled "memory 92" in the schematic of FIG. 2. It will be appreciated, however, that the memory 92 can be integrated into the controller 84 in certain embodiments. Further, the components of the crawler dozer 10 schematically shown in FIG. 2 can be interconnected with the controller 84 utilizing any suitable work vehicle interconnection architecture, whether wired, wireless, or a combination thereof. In many cases, the foregoing components will communicate over a vehicular bus permitting bidirectional signal communication with the controller 84. Generally, then, the individual elements and components of the logic control architecture of the crawler dozer 10 may be implemented in a distributed manner using any number of physically-distinct and operatively-interconnected pieces of hardware or equipment.

As noted above, crawler dozer 10 further includes a blade actuation system 40. The blade actuation system 40 contains a number of blade control linkage cylinders 86 and blade control linkage sensors 88. As schematically illustrated in FIG. 2, the blade control linkage cylinders 86 encompass the hydraulic lift cylinders 42 and the hydraulic pitch cylinders 44 described above in conjunction with FIG. 1. The controller 84 is further operably coupled to the blade control linkage cylinders 86 and can transmit commands thereto. The controller 84 may transmit such commands to the blade control linkage cylinders 86 in accordance with operator input received via the operator controls 16 or in response to automatic blade adjustments determined utilizing the below-described auto blade pitch function. As was the case with the hydrostatic transmission sensors 82, the blade control linkage sensors 88 provide data describing such characteristics to the controller 84 for consideration during performance of the auto blade pitch function. In this regard, the blade control linkage sensors 88 can include various different combinations of force sensors (e.g., load cells) for measuring the forces applied through the blade 30 and the blade control linkage 32, positional sensors (e.g., magnetostrictive linear position sensors) for measuring the stroke of any or all of the control linkage cylinders 86, vibration sensors, wear sensors, and/or various other sensors for monitoring the operational parameters of the blade actuation system 40.

The controller 84 may also receive data inputs from additional data sources 90, which are further coupled to one or more inputs of the controller 84 and which can be distributed across the infrastructure of the example crawler dozer 10. The additional data sources 90 can include any number of sensors generating data that may be utilized by the controller 84 in performing embodiments of the below-described auto blade pitch function. Such additional data sources 90 can include, for example, dozer position data received from a Global Positioning Systems (GPS) included in a Grade Control System (GCS) installed on the crawler dozer 10. Additionally or alternatively, the data sources 90 can include a forward-looking camera useful in estimating the volume of material presently pushed or carried by the blade 30 (referred to below more simply as "blade volume"). The additional data sources 90 can include a ground proximity sensor or other sensor useful in measuring the current cut depth of the blade 30. As a still further example, the additional data sources 90 can include a wireless receiver, which receives data from an external source relevant to the operation of the crawler dozer 10, such as data pertaining to current soil conditions.

When utilized to perform a grading operation or similar task, the work performed with the crawler dozer 10 may be divided into multiple operational phases. These phases may include a loading phase, a carry phase, an offloading or "shedding" phase, and a return phase. During the loading phase, the crawler dozer 10 is controlled such that the blade 30 penetrates into the ground (or other material) to a desired cut depth. Thus, during loading, forward movement of the crawler dozer 10 will typically be primarily resisted by the forces required to shear or dislodge earth and introduce the displaced earth into the volume of loose material pushed by the blade 30 of the crawler dozer 10. This antagonist force is referred to as the "cut and roll resistance force," while the volume of loose material ahead of the blade 30 is referred to as the "pile." The force resisting sliding movement of the pile along the ground is further referred to herein as the "pile slide resistance force." Finally, the cumulative force exerted on the blade 30 through the chassis 12, the blade control linkage 32, and the drive train of the crawler dozer 10 is referred to herein as the "tractive force." These forces are labeled in FIG. 1, and the "pile" accumulated against the blade 30 of the crawler dozer 10 is identified by reference numeral "94." During the loading phase, the crawler dozer 10 will typically progress forward when the tractive force of the crawler dozer 10 exceeds than the summation of the cut and roll resistance force, the pile slide resistance force, and the forces intrinsically resisting movement of the crawler dozer 10, such as track friction, the all-up dozer weight, the ground slope, and the like.

After the crawler dozer 10 completes a given loading phase, the blade 30 is typically lifted such that little to no additional earth is sheared from the ground. The crawler dozer 10 thus enters the carry phase. During the carry phase, the primary antagonistic force resisting forward movement of the crawler dozer 10 will typically be the pile slide resistance force. In this phase, the crawler dozer 10 generally progresses forward when the tractive force of the crawler dozer 10 exceeds the pile slide resistance force and the forces intrinsically resisting movement of the crawler dozer 10. After pushing the pile 94 (FIG. 1) to its desired destination, the crawler dozer 10 disengages from the pile 94 (the shedding phase). The crawler dozer 10 is then repositioned to perform another pass (the return phase), the blade 30 is again lowered into the earth, and the dozer 10 reenters the loading phase. The previously-described work cycle is then repeated.

While less important during the shedding and return phases, the pitch angle of the blade 30 can have a direct impact on work vehicle efficiency during the loading and carry phases. It is thus desirable to maintain the blade pitch angle within an optimal range when operating the crawler dozer 10 through these phases. The optimal blade pitch ($\theta_{OPTIMAL}$) can vary significantly and abruptly, however, in relation to changes in operative phase, cut depth, material type, material density, moisture content, and other dynamic factors. For this reason, the crawler dozer 10 and, specifically, the controller 84 is advantageously configured to perform an auto pitch control function during which controlled adjustments to the pitch of the blade 30 are implemented automatically and without requiring operator input. The below-described auto pitch control function can be performed in an iterative manner such that the blade pitch is repeatedly or continually adjusted to optimized angles as the crawler dozer 10 operates and conditions affecting the optimal blade pitch angle vary. The productivity, fuel consumption, and/or other measures of the crawler dozer 10 may be improved as a result, while the workload of the vehicle operator is reduced. Examples of such an auto pitch control function will now be described in conjunction with FIGS. 3-5.

Figure 3:
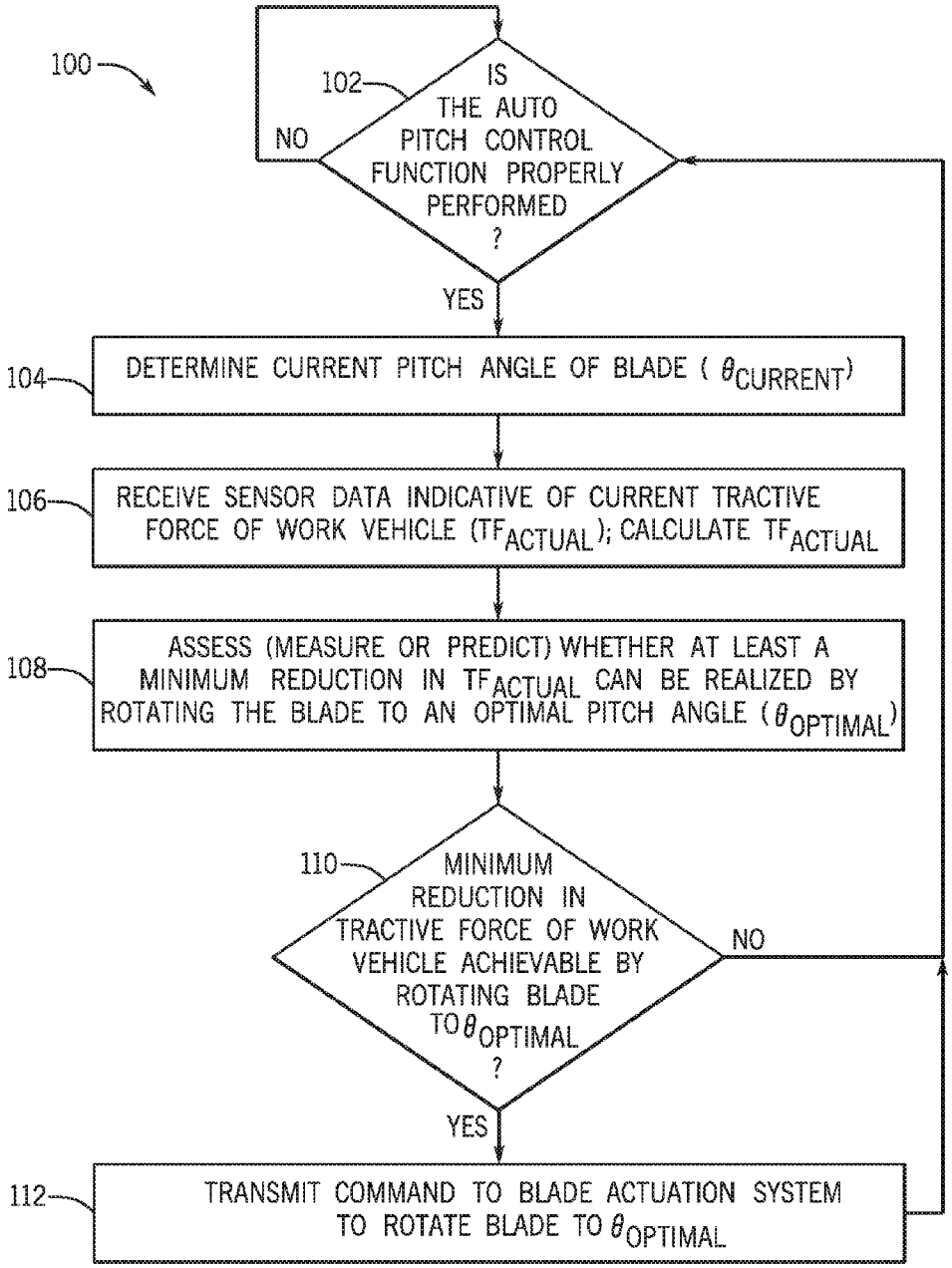
FIG. 3 is a flowchart illustrating an auto pitch control function that may be performed by the example crawler dozer illustrated in FIGS. 1-2, as illustrated in accordance with an example embodiment of the present disclosure.

FIG. 3 is a flowchart illustrating an example Auto Pitch Control ("APC") function 100 that can be performed by the crawler dozer 10 and, specifically, by the controller 84 to identify and automatically implement optimized blade pitch adjustments. The term "automatic" (and derivatives) herein are utilized to indicate that a particular action, task, or process is performed without requiring input from the operator of a bladed work vehicle, such as the crawler dozer 10. For convenience of explanation, the APC function 100 is described below primarily in conjunction with the example crawler dozer 10 shown in FIGS. 1-2. This example notwithstanding, it is emphasized that the APC function 100 can be performed utilizing various other bladed work vehicles. Additionally, it will be understood that the steps shown in FIG. 3 (and the steps shown in FIGS. 4-5, as further described below) can be performed in alternative orders, certain steps may be omitted, and additional steps may be performed in further implementations of the APC function.

The APC function 100 commences by first determining whether the remainder of the APC function 100 is properly performed (STEP 102). In one embodiment, the controller 84 determines whether the APC function 100 is properly performed based upon at least two criteria. First, the controller 84 considers whether an operator of the crawler dozer 10 has activated or deactivated the APC function 100 utilizing the operator controls 16. For example, if the APC function 100 is normally activated by default, the controller 84 can check for the presence of a flag or other signal indicating that the operator has deactivated the APC function 100 utilizing a physical control, by interaction with a graphical user interface (GUI) associated with the operator controls 16, or the like. Additionally, the controller 84 may further determine whether the remainder of the APC function 100 should be performed based upon the current operational phase of the crawler dozer 10. Generally, it will typically be unnecessary, and possibly undesirable, to perform the remainder of the APC function 100 if the crawler dozer 10 is operating in a phase in which the blade pitch angle has little bearing on work vehicle efficiency, such as when the dozer 10 is operating in a shedding or return phase. Thus, the controller 84 may determine that it is proper to perform the remainder of the APC function only if the crawler dozer 10 is currently operating in either a loading phase or a carry phase. As further indicated in FIG. 3, the controller 84 may repeatedly perform STEP 102 until determining that the remainder of the APC function 100 is properly performed.

The controller 84 may be required to identify the phase in which the dozer 10 is currently operating to answer the query posed at STEP 102 (FIG. 3). Similarly, at other steps during the processes or the sub-processes performed in conjunction with the APC function 100, the controller 84 may be required to identify the current operational phase of the crawler dozer 10. The manner in which the controller 84 identifies the current operational phase of the crawler dozer 10 (or other bladed work vehicle) may vary between embodiments. It is generally noted, however, that the controller 84 can identify the current operational phase of the crawler dozer 10 based upon one or more of the following data inputs. First, data indicative of the current height and cut depth of the blade 30 may be utilized to determine whether the crawler dozer 10 is currently operating in a loading phase or a carry phase. Such data may be provided by one or more of the blade control linkage sensors 88 and/or by a GCS included within additional data sources 90. The cumulative forces resisting movement of the crawler dozer 10 may also be considered when determining the phase in which the crawler dozer 10 is currently operating. Generally, the forces resisting movement of the crawler dozer 10 will be relatively high during the loading phase, moderate during the carry phase, and relatively low during the shedding and return phases. As a further possibility, input data received via operator controls 16 can also be considered during STEP 102 to determine the current operational phase of the crawler dozer 10. Image processing of the video feed provided by a forward-looking camera included in the additional data sources 90 can also be utilized to determine or help determine the current operational phase of the crawler dozer 10 in certain embodiments. In still further embodiments, the current position of the crawler dozer 10 can be compared to the location of previous runs and/or to a topographic map of the worksite, as stored in a GCS system included within data sources 90. In yet further embodiments, the current operational phase of the crawler dozer 10 can be determined in another manner.

The current pitch angle of the blade 30 ($\theta_{CURRENT}$) is next determined during STEP 104 of the APC function 100 (FIG. 3). The current pitch angle of the blade 30 ($\theta_{CURRENT}$) can be determined utilizing sensor data received from the blade control linkage sensors 88 and/or from inputs received via operator controls 16. Prior to, concurrent with, or after determining the current blade pitch ($\theta_{CURRENT}$) at STEP 104, the controller 84 may further receive sensor data indicative of a current tractive force of the crawler dozer 10 (STEP 106, FIG. 3). The received data can be indicative of the total or cumulative tractive force of the crawler dozer 10 ($TF_{TOTAL_ACTUAL}$) or a component thereof, such as a component of the tractive force required to overcome pile slide resistance forces ($TF_{SLIDE_ACTUAL}$) or a component of the tractive force required to overcome soil cut and roll resistance forces ($TF_{CUT_ACTUAL}$). The aforementioned parameters are each considered a tractive force of the crawler dozer 10 and may be generically referred to as "$TF_{ACTUAL}$" Such data can be received from any number of sensors or data sources included within the hydrostatic transmission sensors 82, the blade control linkage sensors 88, and the additional data sources 90 shown in FIG. 2.

The manner in which the tractive force of the crawler dozer 10 ($TF_{ACTUAL}$) is determined may vary amongst embodiments, as may the types of input data utilized to calculate or otherwise determine $TF_{ACTUAL}$. By way of non-limiting example, the total tractive force of the crawler dozer 10 ($TF_{TOTAL_ACTUAL}$) may be determined in the following manner. First, the output torque at each of the hydrostatic drive motors 78, 80 may be calculated. The torque at each motor may be determined as the product of piston displacement multiplied by the pressure differential between the high side loop and the low side loop of the hydrostatic transmission 66. Again, such data is provided by the transmission sensors 82 schematically illustrated in FIG. 2. An algorithm or calculation may then be performed utilizing torque output of the hydrostatic drive motors 78, 80 to determine the ground force applied through the tracks 26. Such an algorithm may consider sprocket diameter and the final drive ratio of the final drives 68, 70. Additionally, and as described more fully below in conjunction with FIG. 6, the tractive force calculation may be adjusted to consider the current velocity of the crawler dozer 10, the dozer weight, the efficiency of the hydrostatic transmission 66 (e.g., hydraulic fluid leakage), frictional losses (e.g., a friction co-efficient for the tracks 26), and other such factors.

The controller 84 next advances to STEP 108 of the APC function 100. During STEP 108, the controller 84 assesses whether at least a minimum reduction in a tractive force of the crawler dozer 10 can be achieved by rotating the blade 30 from its current pitch angle ($\theta_{CURRENT}$) to a new, optimized pitch angle ($\theta_{OPTIMAL}$). The controller 84 can assess whether at least a minimum reduction in a tractive force of the crawler dozer 10 can be achieved by rotating the blade to an optimized pitch angle ($\theta_{OPTIMAL}$) by measurement (e.g., by performing a test procedure) or by forecasting utilizing a predictive analytical model. An example process that can be carried-out by the controller 84 during STEP 108 (and STEP 110) of the APC function 100 to measure whether a minimum reduction in a tractive force of the crawler dozer 10 can be achieved by rotating the blade 30 to an optimized pitch angle ($\theta_{OPTIMAL}$) is further described below in conjunction with FIG. 5. An example process that can be performed during STEPS 108, 110 of the APC function 100 to predict or forecast whether a minimum reduction in a tractive force of the crawler dozer 10 can be achieved by rotating the blade 30 to an optimized pitch angle ($\theta_{OPTIMAL}$) is described below in conjunction with FIG. 5.

Advancing to STEP 110 of the APC function 100, the controller 84 next determines whether a minimum reduction in the tractive force of the crawler dozer 10 can be achieved by rotating the blade 30 to an optimized pitch angle ($\theta_{OPTIMAL}$). If determining that a minimum reduction in the tractive force of the crawler dozer 10 can be achieved by rotating the blade 30 to an optimized pitch angle ($\theta_{OPTIMAL}$), the controller 84 transmits a command to the blade actuation system 40 to rotate the blade 30 to $\theta_{OPTIMAL}$. The APC function 100 then concludes its present iteration. If desired, additional iterations of the APC function 100 may be performed at a predetermined refresh rate or continually performed such that the blade 30 is repeatedly rotated to newly-determined optimized blade angles. In this manner, the blade pitch angle may be repeatedly adjusted to new, optimized blade angles in real time or near time in response to variations in the operative conditions of the crawler dozer 10. The APC function 100 can be repeatedly performed throughout the loading phase, the carrying phase, or both the loading and carrying phases in embodiments, as determined by the threshold query posed at STEP 102. Conversely, if it is determined during STEP 110 that a minimum reduction in the tractive force of the crawler dozer 10 cannot be achieved by rotating the blade 30 to an optimized pitch angle ($\theta_{OPTIMAL}$), the controller 84 returns to STEP 102 and the APC function 100 is repeated. Such a minimum threshold helps to eliminate the repeated, minor adjustments in blade pitch angle ("blade flutter") over multiple iterations of the APC function 100.

Figure 4:
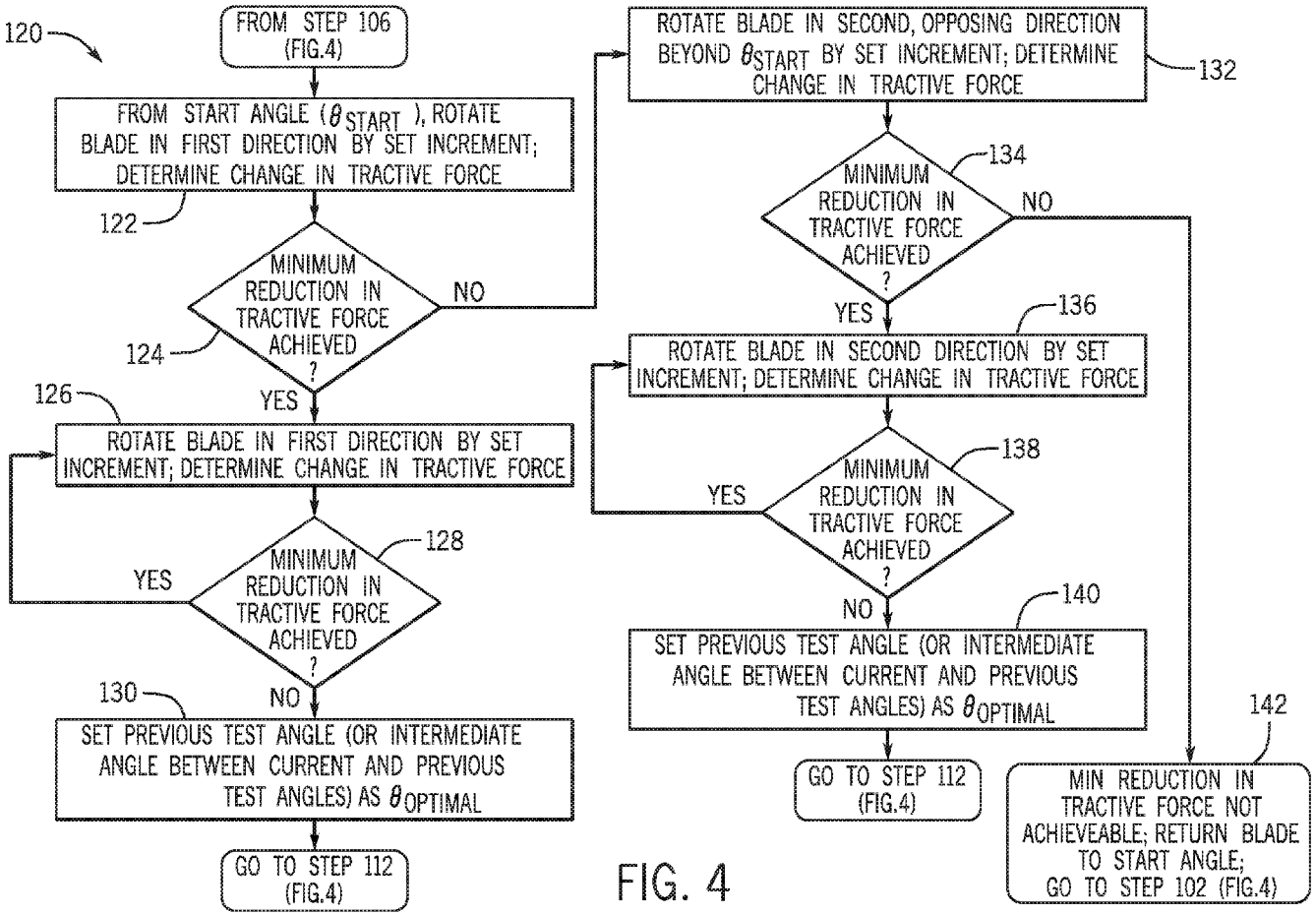
FIG. 4 is a flowchart illustrating a first example process that may be carried-out during the performance of the auto pitch control function (FIG. 3) to measure whether a minimum reduction in a tractive force of the crawler dozer can be achieved by rotating the blade to an optimized pitch angle ($\theta_{OPTIMAL}$)

Turning now to FIG. 4, an example process 120 that can be carried-out by the controller 84 during STEPS 108, 110 of the APC function 100 is set-forth. The example process 120 can be performed during STEPS 108, 110 to measure whether a minimum reduction in a tractive force of the crawler dozer 10 can be achieved by rotating the blade 30 to an optimized pitch angle ($\theta_{OPTIMAL}$) is provided. The example process 120 commences with STEP 122 during which the blade 30 is rotated from an initial pitch angle ($\theta_{START}$) in a first direction by a predetermined increment. To provide a relatively simple example, if the blade pitch angle is currently 60°, the controller 84 may transmit a command to the blade actuation system 40 to rotate the blade 30 to a test pitch angle of 61°. The controller 84 may then determine whether at least a minimum reduction in a tractive force of the crawler dozer 10 (e.g., the cumulative tractive force of the dozer 10; $TF_{TOTAL_ACTUAL}$) has been achieved (STEP 124). Examples of manners in which the tractive force of the crawler dozer 10 can be calculated based upon current sensor data provided by hydrostatic transmission sensors 82, blade control linkage sensors 88, and/or additional data sources 90 have been described above.

If it is determined that at least a minimum reduction in a tractive force of the crawler dozer 10 has been achieved during STEP 124 of the process 120, the controller 84 may again command the blade actuation system 40 to rotate the blade 30 in the first direction by a predetermined increment (STEP 126). For example, and in keeping with the scenario above, the controller 84 may now command the blade actuation system 40 to rotate the blade 30 to a test pitch angle of 62°. The controller 84 may then again determine whether at least a minimum reduction in the tractive force of the crawler dozer 10 has been achieved (STEP 128). If at least a minimum reduction in the tractive force of the crawler dozer 10 has been achieved, STEP 126 and STEP 128 are repeated to continue seeking the optimized pitch angle by incrementally rotating the blade 30 in the first direction. When at least a minimum reduction in the tractive force of the crawler dozer 10 is no longer realized after the last blade pitch adjustment, the process 120 proceeds to STEP 130. At STEP 130, the previous test angle (or an intermediate angle between the current blade pitch angle and the pervious test angle) is set as optimized pitch angle ($\theta_{OPTIMAL}$). To continue the example presented above, if STEP 126 and STEP 128 were repeated while rotating the blade 30 in the first direction by 1° increments until a minimum reduction in the dozer tractive force was no longer achieved after rotating the blade 30 to a pitch angle of 66°, the controller 84 concludes that the optimized pitch angle is either: (i) the previous test angle of 65°, or (ii) an intermediate or "blended" angle between 65° and 66°. Controller 84 may then proceed to STEP 110 of APC function 100 (FIG. 3).

With continued reference to FIG. 4, if instead determining that a minimum reduction in the tractive force of the crawler dozer 10 is not achieved during STEP 124, the controller 84 proceeds to STEP 132. During STEP 132, the controller 84 commands the blade actuation system 40 to rotate the blade 30 in a second, opposing direction beyond the starting blade pitch angle ($\theta_{START}$) by a predetermined increment. To continue the example above, the controller 84 may rotate the blade 30 in the second direction to a pitch angle of 59°. The controller 84 then determines whether at least a minimum reduction in the tractive force of the crawler dozer 10 has been achieved (STEP 134). If at least a minimum reduction in the tractive force of the crawler dozer 10 is not realized, then the controller proceeds to STEP 142 with the determination that a minimum reduction in the tractive force of the crawler dozer 10 is not achievable by altering the pitch angle of the blade 30. The controller 84 may thus resolve that the blade 30 currently resides in an optimized pitch angle or that a substantial gain cannot be achieved by rotating the blade 30 to a different pitch angle. In this case, the controller 84 returns the blade 30 to the initial pitch angle ($\theta_{START}$) and advances to STEP 102 of the APC function 100.

If, at STEP 134 of the process 120, it is determined that a minimum reduction in the tractive force of the crawler dozer 10 is achieved, the controller 84 advances to STEP 136. STEPS 136, 138, and 140 are substantially identical to STEPS 126, 128, and 130 of the process 120 with the exception that the blade 30 is incrementally rotated through test pitch angles in the second, rather than the first, direction. STEPS 136, 138, and 140 will thus not be described in detail other than to note, through the performance of these steps, the controller 84 effectively seeks-out and identifies and an optimized pitch angle ($\theta_{OPTIMAL}$) for the blade 30. After identification of the optimized pitch angle ($\theta_{OPTIMAL}$), the controller 84 advances to STEP 110 of the APC function 100. The process 120 thus concludes and may further be repeated during each iteration of the APC function 100, whether the APC function 100 is performed throughout a selected phase or phases (e.g., throughout the carry and/or loading phases) or instead performed only at the beginning of a selected phase or phases.

Figure 5:
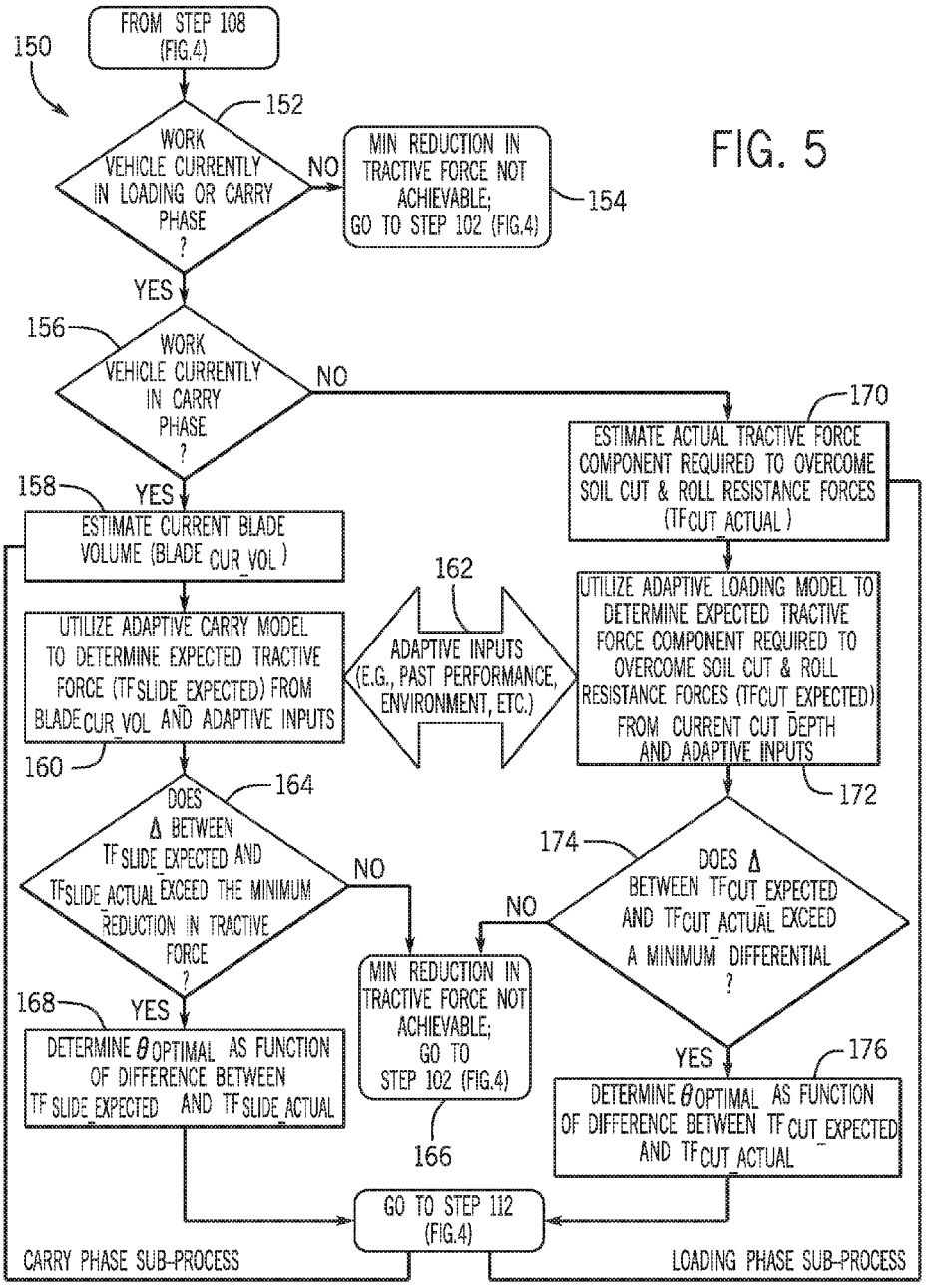
FIG. 5 is a flowchart illustrating a second example process that may be carried-out during the performance of the auto pitch control function (FIG. 3) to predict or forecast whether a minimum reduction in a tractive force of the crawler dozer may be achieved by rotating the blade to an optimized pitch angle ($\theta_{OPTIMAL}$).

Referring now to FIG. 5, there is shown a second example process 150 suitable for performance by the controller 84 during STEPS 108, 110 of the APC function 100. In contrast to the example process 120 described above in conjunction with FIG. 4, the example process 150 does not entail a testing procedure during which an optimized blade pitch angle is physically sought-out through iterative blade pitch angle adjustments and corresponding measurements. Instead, the example process 120 can be performed during STEPS 108, 110 of the APC function 100 to predict or forecast whether a minimum reduction in a tractive force of the crawler dozer 10 can be achieved by rotating the blade 30 to an optimized pitch angle ($\theta_{OPTIMAL}$).

To commence the process 150, the controller 84 determines whether the crawler dozer 10 is currently operating in either a loading or carry phase (STEP 152, FIG. 5). If determining that the crawler dozer 10 is not operating in either a loading or carry phase, the controller 84 concludes that a minimum reduction in the tractive force of the crawler dozer 10 cannot be achieved by adjusting the blade pitch angle (STEP 154, FIG. 5). The controller 84 thus proceeds to STEP 102 of the APC function 100 described above in conjunction with FIG. 3. Conversely, if instead determining that the crawler dozer 10 is operating in either a loading or carry phase, the controller 84 advances to STEP 156 of the process 150. During STEP 156, the controller 84 determines whether the crawler dozer 10 is currently operating in either a carry phase or a loading phase and, therefore, whether a carry phase sub-process or a loading phase sub-process is appropriately performed. The carry phase sub-process is generally identified by a labeled bracket on the left side of FIG. 5, while the loading phase sub-process is identified by a labeled bracket on the right side of the drawing figure. The controller 84 can determine the appropriately performed sub-process by establishing whether the crawler dozer 10 is currently operating in a carry phase during STEP 156 of the example process 150. This determination can be made based upon cut depth of the blade 30 and/or any of the additional factors described above in conjunction with FIG. 3.

If, during STEP 156 of the example process 150, it is determined that the crawler dozer 10 is currently operating in a carry phase, the controller 84 progresses to STEP 158 included in the carry phase sub-process of the process 150. During STEP 158, the controller 84 estimates the current blade volume ($BLADE_{CUR_VOL}$) of the pile 94 (FIG. 1) in contact with the blade 30. The controller 84 may estimate the current blade volume ($BLADE_{CUR_VOL}$) utilizing force data provided by the blade control linkage sensors 88, by image processing of an image provided by a forward-looking camera included in the data sources 90, and/or other sensor data. Additionally or alternatively, the controller 84 may estimate the current blade volume ($BLADE_{CUR_VOL}$) by integrating the cut volume over time. Specifically, the controller 84 may estimate the current blade volume ($BLADE_{CUR_VOL}$) based upon the cut depth of the blade 30 and the distance over which the blade 30 has traveled, while cutting into the ground during the present loading phase. The distance over which the blade 30 has traveled can be determined, in turn, as a product of the duration of the current loading phase multiplied by the velocity of the crawler dozer 10.

After estimating the current blade volume ($BLADE_{CUR_VOL}$) the controller 84 then utilizes an adaptive carry model to establish an expected tractive force of the crawler dozer. The expected tractive force established during STEP 160 can be the cumulative tractive force of the crawler dozer 10 ($TF_{TOTAL_EXPECTED}$) or, instead, a component thereof. In one embodiment, and as indicated in FIG. 5, the controller 84 determines the expected tractive force of the crawler dozer 10 required to overcome the pile slide resistance forces ($TF_{SLIDE_EXPECTED}$) during STEP 160 the carry phase sub-process of the process 150. In many cases, the expected tractive force of the crawler dozer 10 required to overcome the pile slide resistance forces ($TF_{SLIDE_EXPECTED}$) will be similar or substantially equivalent to the cumulative tractive force of the crawler dozer 10 ($TF_{TOTAL_EXPECTED}$) during the carrying phase as the cut depth of the blade 30 will typically be zero or substantially zero.

The expected tractive force of the crawler dozer 10 required to overcome the pile slide resistance forces ($TF_{SLIDE_EXPECTED}$) can be determined based, at least in part, on the current blade volume ($BLADE_{CUR_VOL}$) and adaptive inputs fed into the adaptive carry model (STEP 160). As indicated in FIG. 5 by double-headed arrow 162, the adaptive inputs consider by the controller 84 during STEP 160 can include any combination of environmental conditions, variations in hydrostatic transmission inefficiencies, and variations in friction coefficient of the crawler dozer 10. Such an adaptive model should be contrasted within closed loop proportional-integral-derivative (PID) control schemes that do not evolve or learn over time. By considering such adaptive inputs, the adaptive carry model can effectively adjust or learn over time for increased accuracy in projecting $TF_{SLIDE_EXPECTED}$ under a given set of criteria. For example, if the hydrostatic transmission 66 of the crawler dozer 10 should become less efficient over time due to increased leakage or for another reason, this may be considered by the adaptive carry model during STEP 160 of the example process 150. In other embodiments, the controller 84 may determine $TF_{SLIDE_EXPECTED}$ solely as a function of the current blade volume ($BLADE_{CUR_VOL}$) and/or other sensor inputs provided to the controller 84. The adaptive carrying model may thus generally be described as containing data correlating an expected tractive force of the crawler dozer 10 (e.g., $TF_{TOTAL_EXPECTED}$ or $TF_{SLIDE_EXPECTED}$) to the current blade volume ($BLADE_{CUR_VOL}$).

Continuing with the example process 150 shown in FIG. 5, the controller 84 next determines whether the difference between $TF_{SLIDE_EXPECTED}$ and the actual tractive force of the crawler dozer 10 currently required to overcome the pile slide forces ($TF_{SLIDE_ACTUAL}$) exceeds a minimum threshold value (STEP 164). $TF_{SLIDE_ACTUAL}$ can be determined based upon sensor data, as generally described above. If the difference between $TF_{SLIDE_EXPECTED}$ and $TF_{SLIDE_ACTUAL}$ fails to exceed the minimum threshold value, the controller 84 proceeds to STEP 166 and concludes that a minimum reduction in the tractive force of the crawler dozer 10 is not achievable through an adjustment in the blade pitch angle. Accordingly, the controller 84 advances to STEP 102 of the APC function 100, as previously described. Otherwise, the controller 84 process to STEP 168 of the example process 150. During STEP 168, the controller 84 determines the optimized pitch angle ($\theta_{OPTIMAL}$) as a function of the difference between difference between $TF_{SLIDE_EXPECTED}$ and $TF_{SLIDE_ACTUAL}$ of the crawler dozer 10, as well as the current pitch angle of the blade 30 ($\theta_{CURRENT}$). The controller 84 can utilize any suitable formula or algorithm, a multi-dimensional look-up table, or another logic tool for making this determination. Generally, the larger the disparity between $TF_{SLIDE_EXPECTED}$ and $TF_{SLIDE_ACTUAL}$, the greater the difference between $\theta_{OPTIMAL}$ and $\theta_{CURRENT}$. The controller 84 next proceeds to STEP 112 of the APC function 100 during which the controller 84 transmits a command to the blade actuation system 40 to rotate the blade 30 to $\theta_{OPTIMAL}$.

If determining during STEP 156 of the example process 150 that the crawler dozer 10 is not currently operating in a carry phase, the controller 84 performs the loading phase sub-process illustrated on the right side of FIG. 5. During this sub-process, and referring now to STEP 170 shown in FIG. 3, the controller 84 first estimates the actual tractive force component required to overcome the soil cut and roll resistance forces ($TF_{CUT_ACTUAL}$). This estimation can be made by first calculating the total tractive force of the crawler dozer 10 ($TF_{TOTAL_ACTUAL}$) and then subtracting therefrom the tractive force required to overcome the pile slide resistance forces ($TF_{SLIDE_ACTUAL}$). $TF_{SLIDE_ACTUAL}$ can be estimated or calculated based, at least in part, on an estimated current blade volume ($BLADE_{CUR_VOL}$) as previously described in conjunction with STEP 158 of FIG. 5. Stated differently, during STEP 170, the controller 84 can deduce $TF_{CUT_ACTUAL}$ by first establishing the current total tractive force of the bladed work vehicle ($TF_{TOTAL_ACTUAL}$) and subsequently establishing a tractive force component required to overcome pile slide resistance forces ($TF_{SLIDE_ACTUAL}$). $TF_{CUT_ACTUAL}$ may then be estimated as a function of the difference between $TF_{TOTAL_ACTUAL}$ and $TF_{SLIDE_ACTUAL}$.

Next, at STEP 172, the controller 84 utilizes an adaptive loading model to determine the expected tractive force component required to overcome the soil cut and roll resistance forces ($TF_{CUT_EXPECTED}$) based, at least in part, on the current cut depth of the blade 30 and the adaptive inputs 162. The current cut depth of the blade 30 can be determined utilizing sensor data indicative of the current blade height, force sensor data, image processing of a video feed provided by a forward-looking camera, and/or utilizing other data supplied by the sensors of the crawler dozer 10. Additionally or alternatively, the controller 84 may estimate the current blade volume ($BLADE_{CUR_VOL}$) by integrating the cut volume over time in a manner similar to that discussed above in conjunction with STEP 158 of process 150. As further indicated in FIG. 5 by double-headed arrow 162, the adaptive inputs 162 applied to the adaptive loading model can be identical or similar to those applied to the adaptive carry model described above in conjunction with STEP 160. Thus, such adaptive inputs can include, but are not limited to, environmental conditions, variations in hydrostatic transmission inefficiencies, and variations in friction coefficient of the crawler dozer 10. The adaptive loading model may thus generally be described as containing data correlating an expected tractive force of the of the crawler dozer 10 (e.g., $TF_{CUT_EXPECTED}$) to the current cut depth of the blade 30.

Advancing to STEP 174 of the example process 150, the controller 84 now determines whether the difference between the expected tractive force required to overcome the soil cut and roll forces ($TF_{CUT_EXPECTED}$) and the actual tractive force required to overcome the soil cut and roll forces ($TF_{CUT_ACTUAL}$) exceeds a minimum threshold value. If this is the case, the controller 84 proceeds to STEP 166 and concludes that a minimum reduction in the tractive force of the crawler dozer 10 is not achievable through a blade pitch angle adjustment. Accordingly, the controller 84 advances to STEP 102 of the APC function 100, and the example process 150 concludes. Conversely, if determining that the difference between $TF_{CUT_EXPECTED}$ and $TF_{CUT_ACTUAL}$ exceeds the minimum threshold value, the controller 84 continues to STEP 176 of the example process 150. During STEP 168, the controller 84 determines the optimized pitch angle ($\theta_{OPTIMAL}$) as a function of the difference between $TF_{CUT_EXPECTED}$ and $TF_{CUT_ACTUAL}$, as well as the current pitch angle of the blade 30 ($\theta_{CURRENT}$). In an embodiment, the controller 84 establishes the optimized pitch angle ($\theta_{OPTIMAL}$) by inputting the differential between $TF_{CUT_EXPECTED}$ and $TF_{CUT_ACTUAL}$ and the current pitch angle of the blade 30 ($\theta_{CURRENT}$) into a formula, a multi-dimensional look-up table, or another logic tool. After establishing the optimized pitch angle ($\theta_{OPTIMAL}$), the controller 84 proceeds to STEP 112 of the APC function 100 to implement the corresponding blade pitch adjustment.

The foregoing has thus described systems and methods for automatically adjusting blade pitch in dozers, graders, and other bladed work vehicles. For example, embodiments of an auto pitch control function have been provided, which are useful in assessing whether a minimum reduction in the tractive force of a bladed work vehicle can be realized by rotating the blade to an optimized pitch angle. In certain embodiments, this assessment is accomplished by rotating the blade through a number of test angles, measuring an actual tractive force of the work vehicle at each test angle, and then utilizing the gathered data (e.g., comparing the measured tractive forces) to arrive at the optimized pitch angle ($\theta_{OPTIMAL}$). In other embodiments, the determination of whether a minimum reduction in tractive force can be achieved by rotating the blade to a new optimal blade pitch angle may be predicted or forecast utilizing sensor data and virtual modeling techniques. In either case, the controller may transmit a command to the blade actuation system to implement a blade pitch adjustment when predicting that a minimum reduction in a tractive force of the work vehicle can be achieved through such a blade pitch adjustment. By continually optimizing the blade pitch angle in this manner, embodiments of the systems and methods can improve the overall efficiency of the bladed work vehicle, while helping to reduce the workload of a vehicle operator.

As will be appreciated by one skilled in the art, certain aspects of the disclosed subject matter can be embodied as a method, system (e.g., a work vehicle control system included in a work vehicle), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

Any suitable computer usable or computer readable medium can be utilized. The computer usable medium can be a computer readable signal medium or a computer readable storage medium. A computer-usable, or computer-readable, storage medium (including a storage device associated with a computing device or client electronic device) can be, for example, but is not limited to, an electronic, magnetic, optical, electromagnetic, infrared, or semiconductor system, apparatus, or device, or any suitable combination of the foregoing. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device. In the context of this document, a computer-usable, or computer-readable, storage medium can be any tangible medium that can contain, or store a program for use by or in connection with the instruction execution system, apparatus, or device.

A computer readable signal medium can include a propagated data signal with computer readable program code embodied therein, for example, in baseband or as part of a carrier wave. Such a propagated signal can take any of a variety of forms, including, but not limited to, electromagnetic, optical, or any suitable combination thereof. A computer readable signal medium can be non-transitory and can be any computer readable medium that is not a computer readable storage medium and that can communicate, propagate, or transport a program for use by or in connection with an instruction execution system, apparatus, or device.

Aspects of certain embodiments are described herein can be described with reference to flowchart illustrations and/or block diagrams of methods, apparatus (systems) and computer program products according to embodiments of the invention. It will be understood that each block of any such flowchart illustrations and/or block diagrams, and combinations of blocks in such flowchart illustrations and/or block diagrams, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions can also be stored in a computer-readable memory that can direct a computer or other programmable data processing apparatus to function in a particular manner, such that the instructions stored in the computer-readable memory produce an article of manufacture including instructions which implement the function/act specified in the flowchart and/or block diagram block or blocks.

The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Any flowchart and block diagrams in the figures, or similar discussion above, can illustrate the architecture, functionality, and operation of possible implementations of systems, methods and computer program products according to various embodiments of the present disclosure. In this regard, each block in the flowchart or block diagrams can represent a module, segment, or portion of code, which comprises one or more executable instructions for implementing the specified logical function(s). It should also be noted that, in some alternative implementations, the functions noted in the block (or otherwise described herein) can occur out of the order noted in the figures. For example, two blocks shown in succession (or two operations described in succession) can, in fact, be executed substantially concurrently, or the blocks (or operations) can sometimes be executed in the reverse order, depending upon the functionality involved. It will also be noted that each block of any block diagram and/or flowchart illustration, and combinations of blocks in any block diagrams and/or flowchart illustrations, can be implemented by special purpose hardware-based systems that perform the specified functions or acts, or combinations of special purpose hardware and computer instructions.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. A method for automatically adjusting blade pitch in a bladed work vehicle including a blade, a blade actuation system coupled to the blade, and one or more controllers coupled to the blade actuation system, the method comprising:

determining, by the one or more controllers, a current tractive force of the work vehicle;

establishing, by the one or more controllers, whether the current tractive force of the work vehicle can be reduced by rotating the blade to an optimized pitch angle; and when establishing that the current tractive force of the work vehicle can be reduced by rotating the blade to the optimized pitch angle, transmitting a command from the one or more controllers to the blade actuation system to rotate the blade to the optimized pitch angle.

2. The method of claim 1, wherein establishing comprises:

establishing, by the one or more controllers, an expected tractive force of the work vehicle; and determining, by the one or more controllers, that the current tractive force of the work vehicle can be reduced by rotating the blade to the optimized pitch angle when the current tractive force of the work vehicle exceeds the expected tractive force of the work vehicle by at least a minimum differential.

3. The method of claim 2, wherein determining further comprises determining, by the one or more controllers, the optimized pitch angle at least partially based on a difference between the current tractive force of the work vehicle and the expected tractive force of the work vehicle.

4. The method of claim 1, wherein, in establishing whether the current tractive force of the work vehicle can be reduced by rotating the blade to the optimized pitch angle, the one or more controllers:

identify whether the work vehicle is currently operating in either a loading phase or a carry phase;

establish the optimized pitch angle by a first model when the work vehicle is currently operating in a loading phase; and establish the optimized pitch angle by a second model different than the first model when the work vehicle is currently operating in a carry phase.

5. The method of claim 4, wherein the first model comprises data correlating expected tractive force to cut depth.

6. The method of claim 4, wherein the second model comprises data correlating expected tractive force to blade volume.

7. The method of claim 4, further comprising:

determining, by the one or more controllers, a current cut depth of the blade; and determining, by the one or more controllers, whether the work vehicle is currently operating in a loading phase or a carry phase at least partially based on the estimated current cut depth of the blade.

8. The method of claim 1, further comprising:

identifying, by the one or more controllers, when the work vehicle is currently operating in a loading phase; and when the work vehicle is currently operating in a loading phase, by the one or more controllers to perform a loading phase sub-process comprising:

determining a current tractive force component of the work vehicle required to overcome soil cut and roll resistance forces ($TF_{cut\ actual}$);

establishing an expected tractive force component of the work vehicle required to overcome soil cut and roll resistance forces ($TF_{CUT\ EXPECTED}$); and determining that the current tractive force of the work vehicle can be reduced by rotating the blade to the optimized pitch angle when $TF_{CUT_ACTUA1_}$ exceeds TFcut_expected by a minimum differential.

9. The method of claim 8, wherein establishing $TF_{CUT_EXPECTED}$ comprises establishing $TF_{CUT_EXPECTED}$ as a function of the current cut depth of the blade.

10. The method of claim 1, further comprising:

identifying, by the one or more controllers, when an auto pitch control function is active; and repeating the steps of determining, establishing, and transmitting until the auto pitch control function is deactivated.

11. The method of claim 1, wherein, in establishing whether the current tractive force of the work vehicle can be reduced by rotating the blade to the optimized pitch angle, the one or more controllers:

command the blade actuation system to rotate the blade to a plurality of test pitch angles, while receiving data indicative of a tractive force of the work vehicle at each of the plurality of test pitch angles; and determine the optimized pitch angle at least partially based on one or more of the plurality of test pitch angles at which the tractive force of the work vehicle is the least.

12. The method of claim 1, further comprising:

identifying, by the one or more controllers, whether the work vehicle is currently operating in either a loading phase or a carry phase;

transmitting a command from the one or more controllers to the blade actuation system to rotate the blade to a first optimized pitch angle if the work vehicle is currently operating in the loading phase; and transmitting a command from the one or more controllers to the blade actuation system to rotate the blade to a second optimized pitch angle if the work vehicle is currently operating in the loading phase, the second optimized pitch angle different than the first optimized pitch angle.

13. A bladed work vehicle, comprising:

a blade having a pitch angle;

a blade actuation system coupled to the blade and configured to adjust the pitch angle thereof;

one or more sensors configured to provide data indicative of a current tractive force of the work vehicle; and one or more controllers coupled to the blade actuation system and to the one or more sensors, the one or more controllers including instructions for the execution of an auto pitch control function during which the one or more controllers:

receive sensor data from the one or more sensors indicative of a current tractive force of the work vehicle;

determine whether the current tractive force of the work vehicle can be reduced by rotating the blade to an optimized pitch angle by the sensor data; and when determining that the current tractive force of the work vehicle can be reduced by rotating the blade to the optimized pitch angle, automatically transmit a command from the one or more controllers to the blade actuation system to rotate the blade to the optimized pitch angle.

14. The bladed work vehicle of claim 13, wherein the one or more controllers further:

identify when the work vehicle is currently operating in a loading phase; and execute a loading phase algorithm when identifying that the work vehicle is currently operating in a loading phase;

wherein the load phase algorithm comprises:

determining a tractive force component required to overcome soil cut and roll resistance forces ($TF_{cut\ actual}$);

determining a blade pitch adjustment at least partially based on $TF_{cut_actual}$; and transmitting a command to the blade actuation system to implement the blade pitch adjustment.

15. The bladed work vehicle of claim 13, wherein the one or more controllers further:

identify when the work vehicle is currently operating in a loading phase;

transmit a command from the one or more controllers to the blade actuation system to rotate the blade to a first optimized pitch angle if the work vehicle is currently operating in the loading phase; and transmit a command from the one or more controllers to the blade actuation system to rotate the blade to a second optimized pitch angle if the work vehicle is currently operating in the loading phase, the second optimized pitch angle different than the first optimized pitch angle.

* * * * *